US007905621B1

(12) United States Patent
Hickman et al.

(10) Patent No.: US 7,905,621 B1
(45) Date of Patent: Mar. 15, 2011

(54) IN-GRADE LIGHTING FIXTURE

(75) Inventors: James Hickman, New Oxford, PA (US); Matthew Pressel, Waynesville, NC (US); Michael Riebling, Hanover, PA (US); David Smith, Littlestown, PA (US); Lew Waltz, Hanover, PA (US)

(73) Assignee: Genlyte Thomas Group, LLC, Louisville, KY (US)

( * ) Notice: Subject to any disclaimer, the term of this patent is extended or adjusted under 35 U.S.C. 154(b) by 485 days.

(21) Appl. No.: 12/016,764

(22) Filed: Jan. 18, 2008

(51) Int. Cl.
*E01F 9/00* (2006.01)

(52) U.S. Cl. ..... 362/153.1; 362/374; 362/375; 362/145; 362/362

(58) Field of Classification Search ..... 362/153.1, 362/374, 375, 145, 362
See application file for complete search history.

(56) References Cited

U.S. PATENT DOCUMENTS

| | | | |
|---|---|---|---|
| 1,057,178 | A | 3/1913 | Sessions |
| 1,228,155 | A | 5/1917 | Williams |
| 1,388,221 | A | 8/1921 | Toepfer |
| 1,539,131 | A | 5/1925 | McCarley |
| 1,611,651 | A | 12/1926 | Leavitt |
| 1,695,413 | A | 12/1928 | Crockett |
| 1,701,176 | A | 2/1929 | Doane |
| 2,198,077 | A | 4/1940 | Curtis |
| 2,247,671 | A | 7/1941 | Tepel |
| 2,285,728 | A | 6/1942 | Leinen |
| 2,288,166 | A | 6/1942 | Kucher |
| 2,313,131 | A | 3/1943 | Elias |
| 2,545,163 | A | 3/1951 | Naster |
| 2,852,663 | A | 9/1958 | Stuffer et al. |
| 2,877,288 | A | 3/1959 | Bollmeier |
| 2,935,601 | A | 5/1960 | Steiner et al. |
| 2,962,583 | A | 11/1960 | Balser |
| 2,973,895 | A | 3/1961 | Brown et al. |
| 3,078,366 | A | 2/1963 | Winkler |
| 3,096,024 | A | 7/1963 | Young |
| 3,154,704 | A | 10/1964 | Shaffer |
| 3,299,200 | A | 1/1967 | Sulzer |
| 3,319,203 | A | 5/1967 | Houghney |
| 3,339,066 | A | 8/1967 | Hart |
| 3,350,554 | A | 10/1967 | Wood |
| 3,435,202 | A | 3/1969 | Jabonski |
| 3,479,081 | A | 11/1969 | Schaaf |
| 3,541,478 | A | 11/1970 | Peterson et al. |
| 3,604,921 | A | 9/1971 | Wood et al. |
| 3,745,326 | A | 7/1973 | Hernandez |
| 3,845,435 | A | 10/1974 | Georgopulos |
| 3,852,588 | A | 12/1974 | Crawford |
| 3,869,563 | A | 3/1975 | Ocken, Jr. |
| 3,879,575 | A | 4/1975 | Dobbin et al. |
| 3,949,213 | A | 4/1976 | Paitchell |
| 4,000,406 | A | 12/1976 | Bhavsar |
| 4,007,365 | A | 2/1977 | Stempfle et al. |
| 4,112,483 | A | 9/1978 | Small, Jr. et al. |

(Continued)

*Primary Examiner* — Sandra L O Shea
*Assistant Examiner* — Jessica L McMillan

(57) ABSTRACT

An in-grade light fixture has a lamp compartment having an open upper end with a lens cover covering the open upper end. The lens cover may have a joint connection to permit travel from an open configuration to a closed configuration. A junction box is adjacent to the lens cover along an upper portion of the compartment. If a ballast is utilized for proper supply of power to the lamp, a ballast compartment is adjacent an open lower end of the lamp compartment. A hydraulic isolation chamber extends vertically downward from the junction box to the sealed ballast compartment. The hydraulic isolation chamber is filled with a potting material and prevents wicking of moisture into the ballast compartment.

20 Claims, 9 Drawing Sheets

U.S. PATENT DOCUMENTS 4,142,179 A 2/1979 Lowndes
4,143,508 A 3/1979 Ohno
4,180,850 A 12/1979 Bivens
4,254,456 A 3/1981 Grindle et al.
4,266,659 A 5/1981 Meyer et al.
4,293,898 A 10/1981 Budnovitch et al.
4,310,876 A 1/1982 Small, Jr. et al.
4,323,954 A 4/1982 Florence et al.
4,342,074 A 7/1982 Bull et al.
4,343,033 A 8/1982 Suzuki
4,344,118 A 8/1982 Rundquist et al.
4,364,108 A 12/1982 Rapp
4,384,316 A 5/1983 de Vos et al.
4,396,972 A 8/1983 Kaneko et al.
4,422,135 A 12/1983 McCamy
4,433,366 A 2/1984 Wade
4,433,776 A 2/1984 Edwards, Jr. et al.
4,445,163 A 4/1984 Ziaylek, Jr.
4,447,859 A 5/1984 Raczynski
4,458,301 A 7/1984 Chapman et al.
4,460,944 A 7/1984 Gordbegli et al.
4,489,368 A 12/1984 Sangiamo et al.
4,503,486 A 3/1985 Makita
4,507,715 A 3/1985 Wedding
4,527,224 A 7/1985 Sangiamo et al.
4,533,984 A 8/1985 Gatton
4,539,629 A 9/1985 Poppenheimer
4,548,316 A 10/1985 Maurer
4,561,203 A 12/1985 MacDonald, Jr. et al.
4,568,155 A 2/1986 Shimizu
4,574,337 A 3/1986 Poppenheimer
4,610,738 A 9/1986 Jervis
4,617,616 A 10/1986 Juell et al.
4,621,307 A 11/1986 Weber
4,661,893 A 4/1987 Robinson et al.
4,675,794 A 6/1987 Fink, Jr. et al.
4,695,930 A 9/1987 Wierbicki et al.
4,697,950 A 10/1987 Copeland
4,742,818 A 5/1988 Hughes et al.
4,744,014 A 5/1988 Harris
4,760,508 A 7/1988 Russello et al.
4,760,511 A 7/1988 Russello et al.
4,794,501 A 12/1988 Bartenbach
4,797,797 A 1/1989 Collot et al.
4,812,703 A 3/1989 Kanematsu et al.
4,832,425 A 5/1989 Walther et al.
4,835,667 A 5/1989 Wolfe
4,870,548 A 9/1989 Beachy et al.
4,872,548 A 10/1989 Masuda et al.
4,881,152 A 11/1989 Watanabe et al.
4,890,903 A 1/1990 Treisman et al.
4,907,139 A 3/1990 Quiogue
4,930,054 A 5/1990 Krebs
4,931,914 A 6/1990 Quiogue
4,931,915 A 6/1990 Quiogue
4,947,307 A 8/1990 Quiogue
4,956,561 A 9/1990 Tamer
4,970,634 A 11/1990 Howell et al.
4,972,301 A 11/1990 Kasboske
4,984,139 A 1/1991 Goggia
4,992,914 A 2/1991 Heiss et al.
4,998,894 A 3/1991 Gronvall
4,999,757 A 3/1991 Poppenheimer
5,003,436 A 3/1991 Yamada et al.
5,015,917 A 5/1991 Nigg
5,016,151 A 5/1991 Mula
5,029,054 A 7/1991 Trainor
5,029,056 A 7/1991 Patterson, Jr.
5,041,950 A 8/1991 Tyson
5,050,052 A 9/1991 Wade
5,055,980 A 10/1991 Mochizuki
5,055,987 A 10/1991 Ellson et al.
5,060,127 A 10/1991 Birt
5,070,434 A 12/1991 Suman et al.
5,072,345 A 12/1991 Goggia
5,075,834 A 12/1991 Puglisi
5,084,809 A 1/1992 Bogdanovs
5,117,342 A 5/1992 Vlah
5,124,902 A 6/1992 Puglisi
5,134,557 A 7/1992 Gordin et al.
5,144,542 A 9/1992 Puglisi
5,150,172 A 9/1992 Brierley
5,150,958 A 9/1992 Miyazawa et al.
5,156,454 A 10/1992 White
5,156,788 A 10/1992 Chesterfield et al.
5,158,352 A 10/1992 Ikegami et al.
5,160,202 A 11/1992 Legare
5,161,876 A 11/1992 Smith
5,161,883 A 11/1992 Gordin et al.
5,171,085 A 12/1992 Jaksich
5,198,962 A 3/1993 Tyson
5,207,499 A 5/1993 Vajda et al.
5,230,559 A 7/1993 Porter et al.
5,249,110 A 9/1993 Russello et al.
5,276,583 A 1/1994 Tyson
5,309,342 A 5/1994 Heinen, Sr.
RE34,709 E 8/1994 Tyson
5,335,151 A 8/1994 Dahlberg
5,349,505 A 9/1994 Poppenheimer
5,408,397 A 4/1995 Tyson
5,414,603 A 5/1995 Conway
5,436,812 A 7/1995 Stevart
5,481,443 A 1/1996 Wagner et al.
5,483,428 A 1/1996 Poppenheimer
5,486,988 A 1/1996 Tyson
5,541,362 A 7/1996 Reinert, Sr.
5,556,188 A 9/1996 Poppenheimer
5,556,189 A 9/1996 Wallis
5,567,170 A 10/1996 Kroeber
5,727,873 A 3/1998 Tyson
5,743,622 A 4/1998 Ibbitson et al.
5,779,349 A 7/1998 Reinert, Sr.
5,887,966 A 3/1999 Eissner et al.
5,908,236 A * 6/1999 Lueken et al. ..... 362/364
6,068,384 A 5/2000 Tyson et al.
6,088,875 A 7/2000 Ono et al.
6,106,134 A 8/2000 Bomas
6,165,013 A 12/2000 Broussard
6,175,487 B1 1/2001 McCartney et al.
6,231,214 B1 5/2001 Haugaard
6,523,982 B1 2/2003 Haddad
6,578,233 B1 6/2003 Avila et al.
7,011,436 B2 * 3/2006 Riebling et al. ..... 362/487
7,033,038 B2 4/2006 Hagen
7,097,330 B1 8/2006 Straus et al.
2005/0111216 A1 5/2005 Reinert, Sr.
2006/0262542 A1 * 11/2006 Ibbitson et al. ..... 362/368
2006/0291197 A1 12/2006 Patti

* cited by examiner

IN-GRADE LIGHTING FIXTURE

TECHNICAL FIELD

The present invention relates to in-grade luminaires which hydraulically isolate the separate compartments of the fixture to prevent water seepage into the optical and electrical compartments of the fixture. Water entry into an in-grade luminaire must be prevented since such seepage can prevent the optics and electronics from proper operation. Water can enter through incorrect seals, cracked or old seals, wicking through the wire, or by other means.

DETAILED DESCRIPTION

Figure 1:
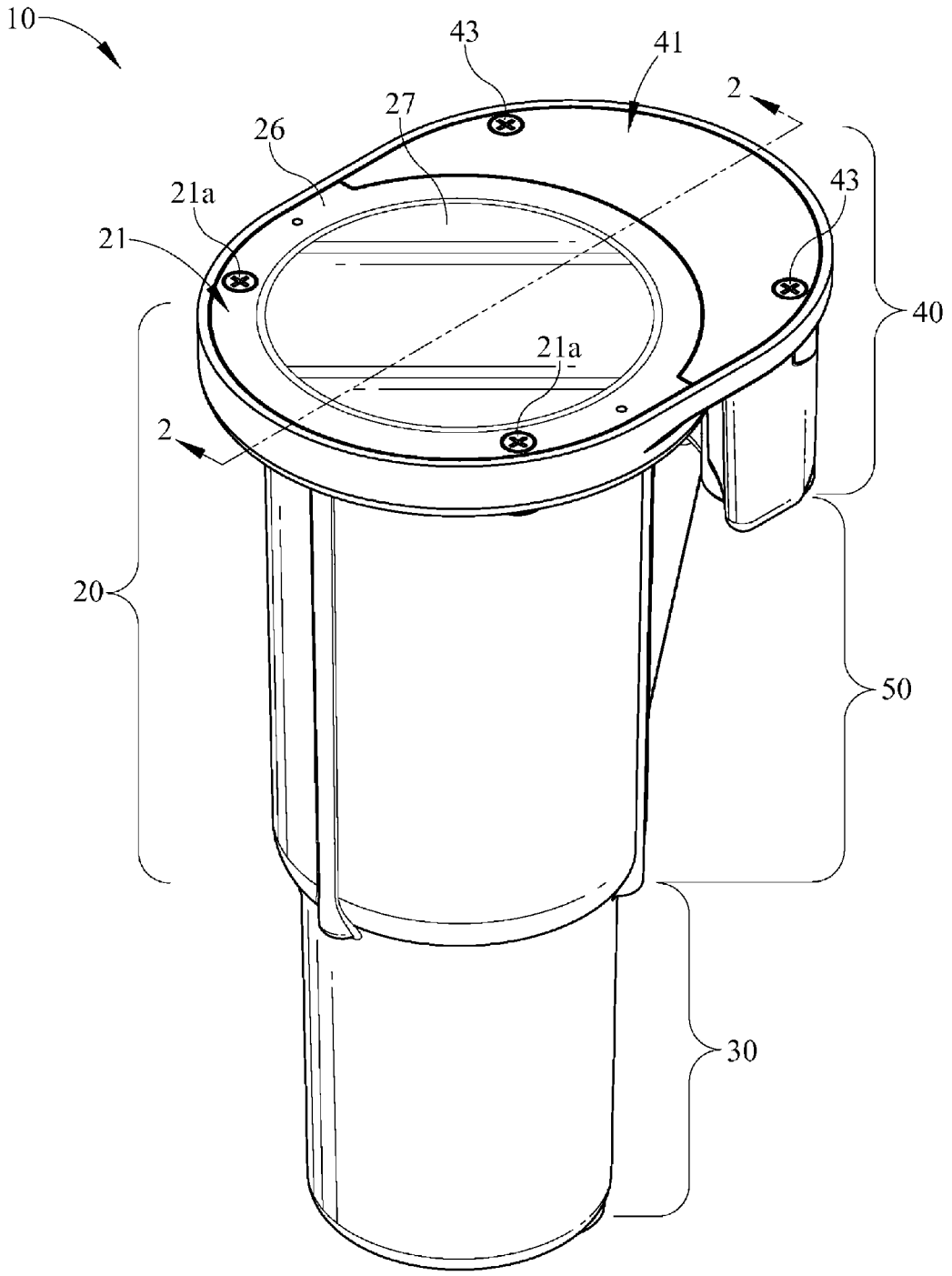
FIG. 1 is a front perspective view of an in-grade light fixture embodiment in a closed configuration.

An embodiment of an in-grade light fixture 10 is shown in FIGS. 1-7 wherein multiple compartments are hydraulically isolated from each other. A lamp compartment 20 is provided which contains a lamping module 60. A ballast compartment 30 containing a lamp power device such as but not limited to a ballast box 31, electronic, magnetic, step down, or LED drivers. A side car junction box or splice compartment 40 is provided for electrical connection of the power supply wires from the external source to the internal wiring for in-grade fixture 10. Interposed between side car junction box 40 and ballast compartment 30 is a hydraulic isolation chamber 50 which extends vertically therebetween and which may be deemed a potting compartment for hydraulic isolation of the junction box, the wires contained therein, and between the internal portion of the ballast compartment.

Figure 2:
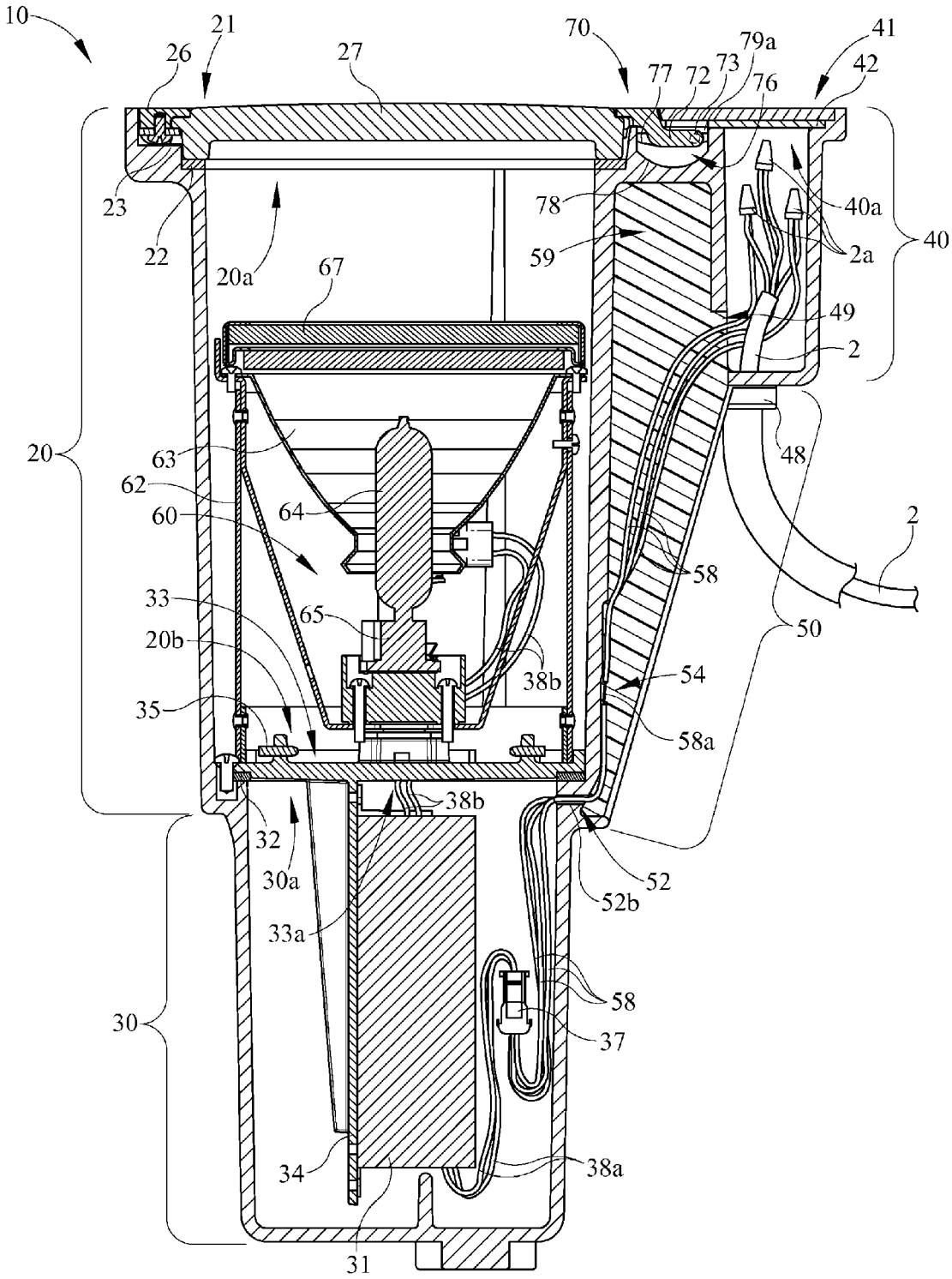
FIG. 2 is a sectional view of the in-grade light fixture taken along line 2-2 of FIG. 1.

As may be readily seen from the figures, and in particular referring to FIG. 2, side car junction box 40 has an opening 40*a* on an upper portion thereof, opening 40*a* positioned so that a cover 41 is substantially at ground level adjacent to a lens cover 21 of lamp compartment 20 of the in-grade fixture. Side car junction box 40 has cover 41 for proper sealing of the junction box from external moisture and may be sealed after the external wires 2 from the external power supply (not shown) are electrically connected with internal electrical wires 58, shown in FIG. 2, for in-grade fixture 10. Junction box cover 41 may be of a brass or stainless steel. Side car junction box 40 has conduit entries 48 allowing external wires 2 to enter into the side car junction box for joining with internal electrical wires 58. Either one of conduit entries 48 may allow a second set of external wires (not shown) to be connected to a second in-grade light fixture in series with light fixture 10. Side car junction box 40 has an internal splice compartment which is removed from the other compartments, such as but not limited to lamp compartment 20, hydraulic isolation chamber 50, ballast compartment 30, thereby preventing water leakage between the compartments.

As shown in FIGS. 1-6, side car junction box 40, as indicated, has cover 41 over opening 40*a* which is substantially at ground level and adjacent to lens cover 21. External wires 2 may be fed into side car junction box 40 for direct connection to internal electrical wires 58. A seal or gasket 42 is positioned between junction box cover 41 and junction box compartment 40 creating a sealing engagement. Gasket 42 may be of a closed cell sponge seal such as a die cut gasket and adhesively attached to junction box cover. This results in at least gasket 42 and possibly the fasteners 43 to stay with junction box cover 41 when handling by the user. Junction box compartment 40 or junction box cover 41 may also include a positive stop or bosses, about an eighth of an inch, preventing gasket 42 from being over compressed and failing to seal junction box compartment. Seal putty and thread tape may be used on external wires 2 and conduit coming into or out of junction box 40 sealing this engagement. Also, liquid tight wire nuts 2*a* may also be used to connect external wires 2 to internal electrical wires 58. Also located within the side car junction box 40 may be encapsulant material (not shown) for sealing of the side car junction box after splicing of external wires 2 to internal wires 58. The encapsulant may surround and seal the wire connections and conduit entry points. The encapsulant utilized may remain a viscous liquid, gelatinous consistency or cure to a rubber or solid material such as RTV silicate. Once the wires are electrically connected, the encapsulant may be poured into side car junction box 40 and junction box cover 41 may be placed thereon to assure that no water leaks from the side car junction box into the hydraulic isolation chamber 50.

Figure 7:
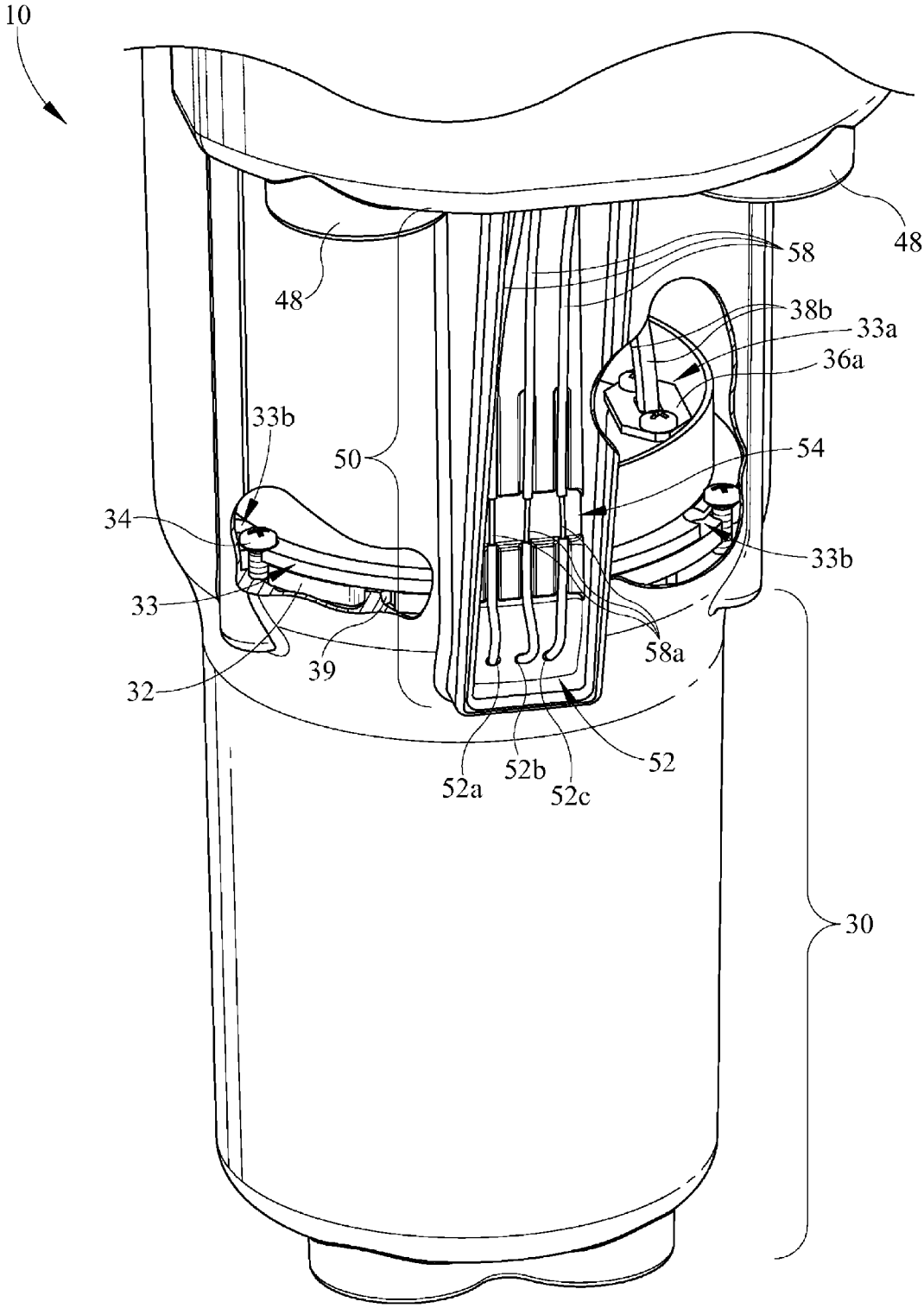
FIG. 7 is an enlarged, rear perspective view of the in-grade light fixture of FIG. 1 with portions of the fixture partially broken away and the potting material removed.

As shown in FIGS. 1, 2, and 7, hydraulic isolation chamber 50 extends vertically between side car junction box 40 and extending through the wall of ballast compartment 30 providing electrical connectivity to ballast box 31 of in-grade fixture 10. Hydraulic isolation chamber 50 is provided such that internal wires 58 extending therethrough may be surrounded by a potting compound or material 59 which cures to a hardened state. Potting material 59 may be, but is not limited to, Hysol® ES4512. By placing potting material 59 into hydraulic isolation chamber 50, the potting material seals side car junction box 40 and ballast compartment 30 from moisture originating from other compartments and from outside of the fixture 10. Prior to placement of potting material 59 within hydraulic isolation chamber 50, wires 58, as shown in FIG. 2, are placed so as to extend through the vertically extending hydraulic isolation chamber and are electrically connected to a pin interface of a male/female connector 37 inside of ballast compartment 30. Thus, internal wires 58 extend from side car junction box 40 to connector 37 into the interior of ballast compartment 30. As shown in FIG. 7, internal wires 58 are permitted to extend through the ballast compartment wall by an aperture interface 52 having at least one aperture or a plurality of apertures 52*a*, 52*b*, 52*c* each receiving a wire 58. As shown in FIG. 7, each internal wire 58 is also stripped of its plastic jacket to expose a portion of bare wire 58*a*. The stripped jacket or bare wire 58*a* is preferably about a half inch in length, but may be of any dimension. This portion of each bare wire 58*a* is positioned across a groove 54 whereby the subsequently filled-in potting material 59 into chamber 50 is able to flow into groove 54 and more specifically surround the circumference of each bare wire 58*a* to provide an anti-wicking mechanism preventing moisture from being transferred along wires 58 from one compartment to another. Internal wires 58 may be adhesively or mechanically, for example taped or vertical grooves as shown in FIG. 7, held to position each bare wire 58*a* across groove 54 while potting material 59 is applied. Each bare wire 58*a* is separated from each other and extends across a portion of the groove 54 to provide clearance around the circumference of each bare wire 58*a*. The clearance provided by the groove 54 allows the potting material 59 to be applied and fully flow around each bare wire to completely encapsulate the bare wire to provide anti-wicking. The vertically extending hydraulic isolation chamber 50 therefore adequately isolates side car junction box 40 and internal electrical wires 58 from the internal electrical components of ballast compartment 30.

As shown in FIG. 2, substantially the entire hydraulic isolation chamber 50 with groove 54 is filled with potting material 59 and the material surrounds wires 58 and bare wires 58*a*, the aperture interface 52 between hydraulic isolation chamber 50 and ballast chamber 30, and an aperture interface 49 between the hydraulic isolation chamber 50 and junction box 40 thereby preventing any moisture from progressing between the ballast compartment and the junction box even should water wick through the wires. With bare wires 58*a* surrounded by potting material 59, a water tight barrier is placed between the ballast compartment and the junction box.

Also shown in FIG. 2, side car junction box 40 therefore is maintained in moisture free condition by liquid tight wire nuts 2*a*, sealed cover 41 on opening 40*a* thereof, the seal putty and thread tape of the line voltage inlet 48 and possibly line voltage outlet to a second fixture, and potting material 59 set within hydraulic isolation chamber 50. Any moisture therefore is prevented by entry into lamp compartment 20 or ballast compartment 30.

As shown in FIGS. 2 and 7-9, within ballast compartment 30 are found lamp wires 38*b* which electrically connect ballast box 31 with lamp module 60 of lamp compartment 20, and ballast wires 38*a* which electrically connect through male/female connection 37 with internal electrical wires 58. Ballast compartment 30 is sealed on an open upper end 30*a* by a ballast cover 33 which has an aperture 33*a* for allowing lamp wires 38*b* to connect ballast box 31 to lamp module 60 in lamp compartment 20. Ballast cover 33 not only is in sealing engagement with ballast compartment 30, but it also permits the user to access the ballast compartment for maintenance and installation of ballast box 31. Lamp compartment 20 encloses and positions lamping module 60. Lamp compartment 20 is sealed at an open upper end 20*a* by a lens cover 21. Lens cover 21 has a lens 27 which may be in contact with a gasket 22 at its lower end and may further be substantially surrounded by a lens ring 26 at its upper end. Ballast cover 33 seals an open lower end 20*b* of lamp compartment 20 creating a sealed lamp compartment separate from the other housing compartments of fixture 10. Open lower end 20*b* of lamp compartment 20 coincides with open upper end 30*a* of ballast compartment 30. Lens 27 is in sealing engagement with lamp compartment 20 by means of gasket 22 thereby preventing any moisture from entering into lamp compartment 20 from the outside. Gasket 22 is positioned between lens 27 and lamp compartment 20 creating a sealing engagement. Gasket 22 may be adhered to the lens but may alternatively be positioned separately within lamp compartment 20. The lens cover 21 and lamp compartment 20 engagement includes ledge 23 which interact with lens ring 26 to preclude over compression of gasket 22. Ledge 23 projects from the upper end of lamp compartment as shown in FIGS. 2, 3, 5, and 6. If gasket 22 is secured upon lens 27, the gasket may be seen through the lens resulting in a "visual seal" because the gasket engagement with the lens changes appearance upon being compressed. For example but not limited to changes in the color of the seal and lens engagement may indicate a sufficient sealing engagement and an incomplete sealing engagement. It is to be understood that although gasket 22 is sealed between lens 27 and lamp compartment 20, any number of sealing methods, constructions, quantities, and orientations known in the art may be used to seal the lens cover to the lamp compartment.

Figure 3:
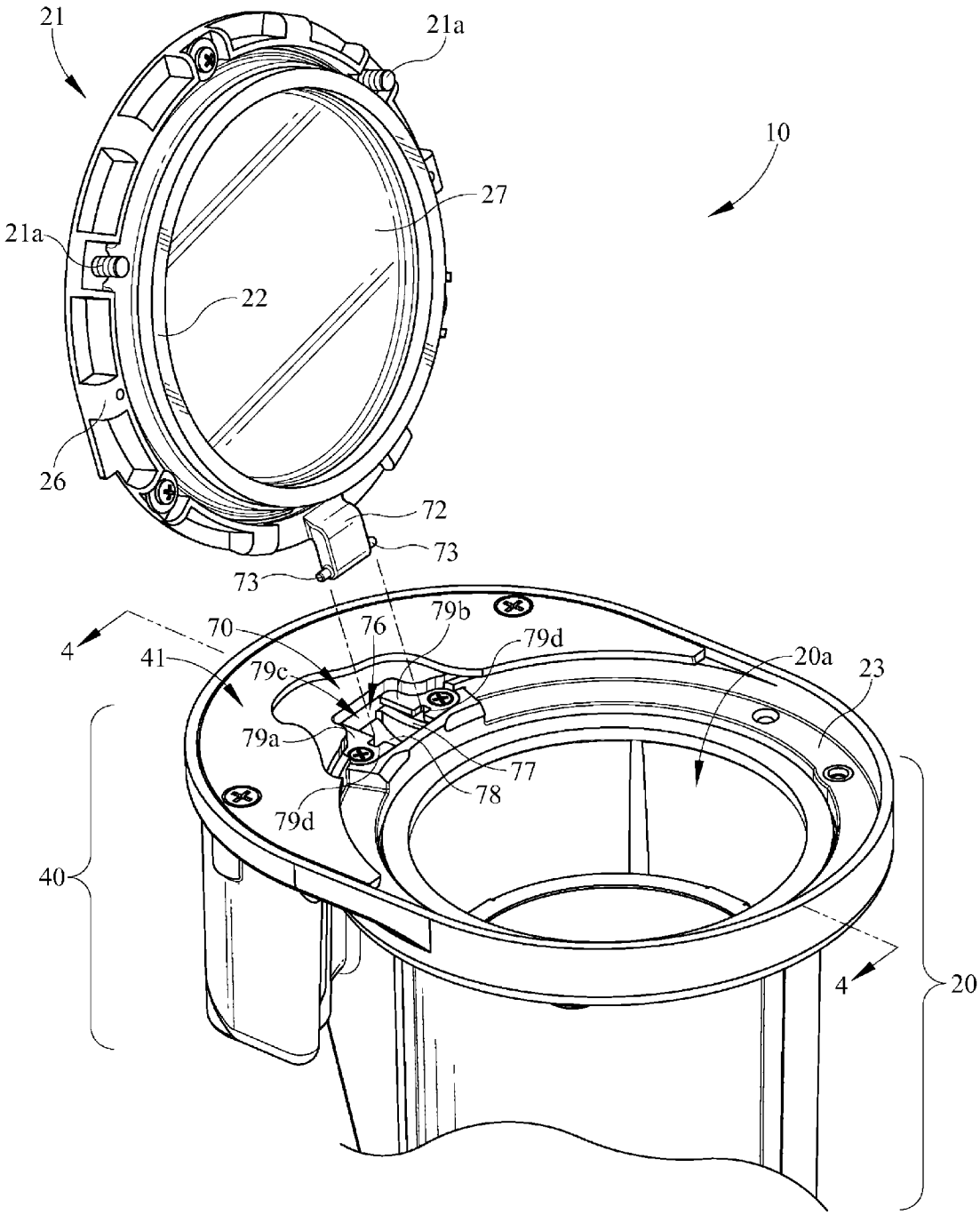
FIG. 3 is an enlarged perspective view of a joint connection of the lens cover of the in-grade light fixture of FIG. 1 with the lens cover exploded away from the light fixture and the junction box cover partially broken away.
Figure 4:
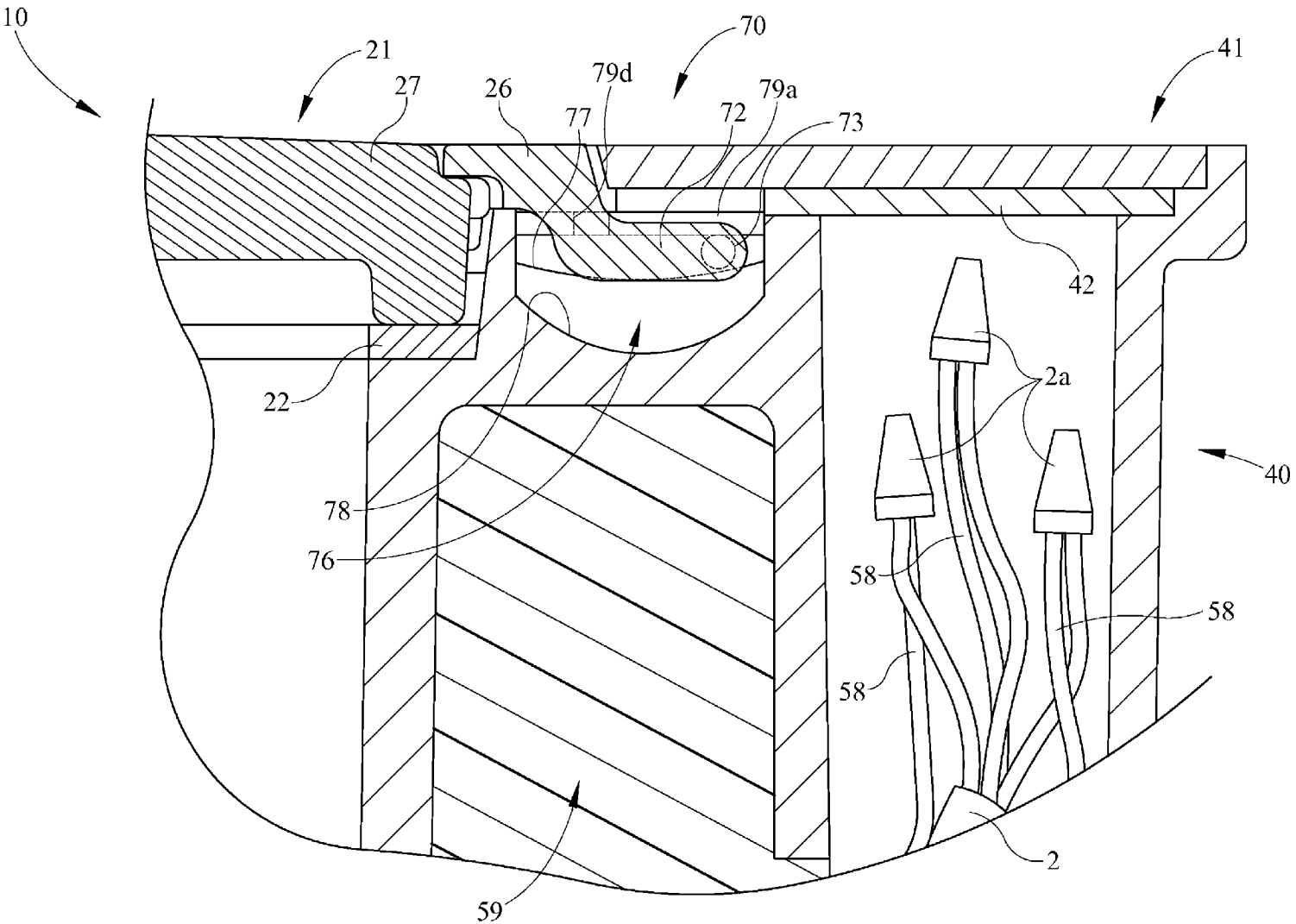
FIG. 4 is an enlarged sectional view of the joint connection of the lens cover in a closed configuration taken along line 4-4 of FIG. 3.
Figure 5:
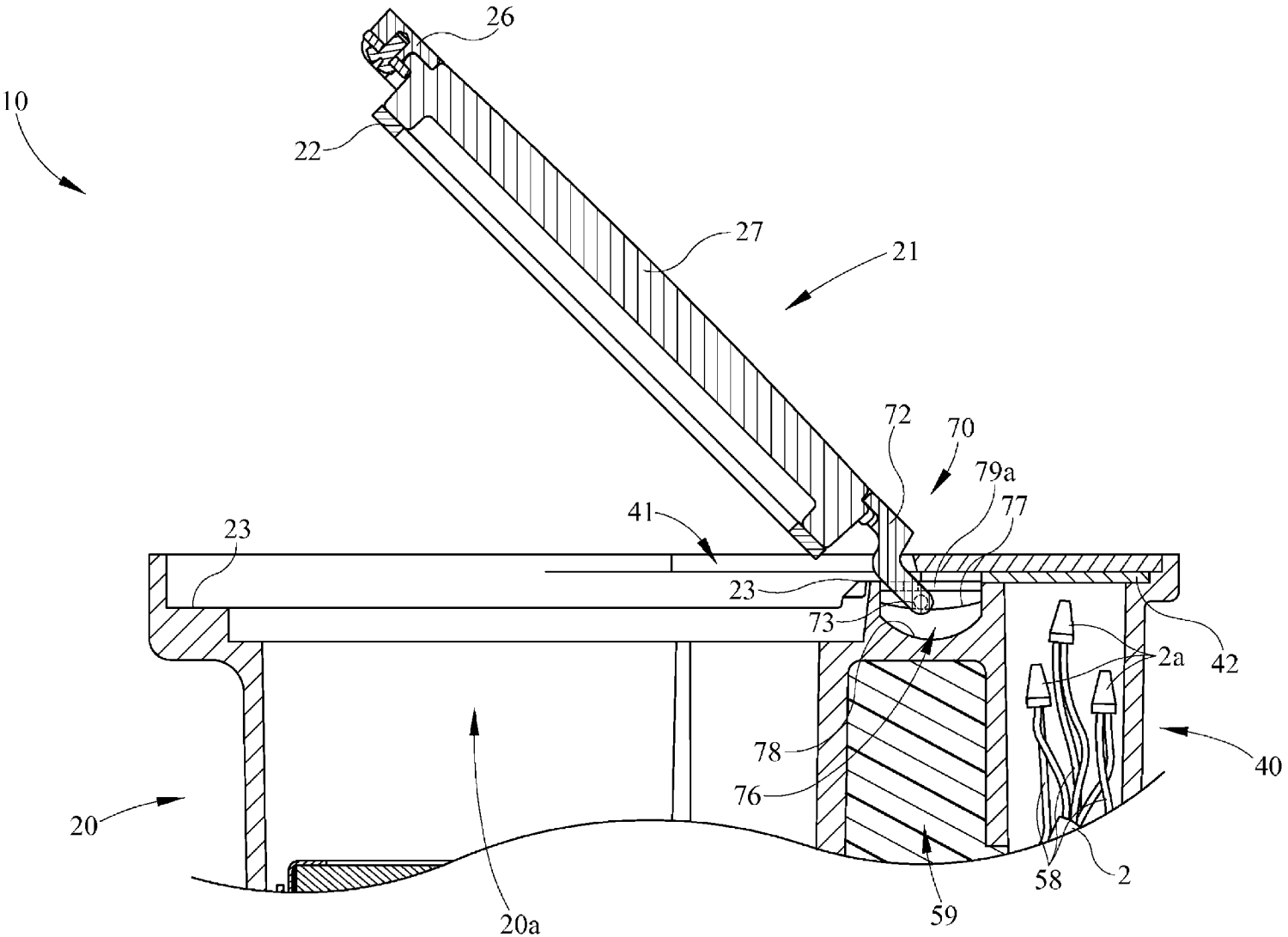
FIG. 5 is an enlarged sectional view of the joint connection of the lens cover in a partially open configuration taken along line 4-4 of FIG. 3.
Figure 6:
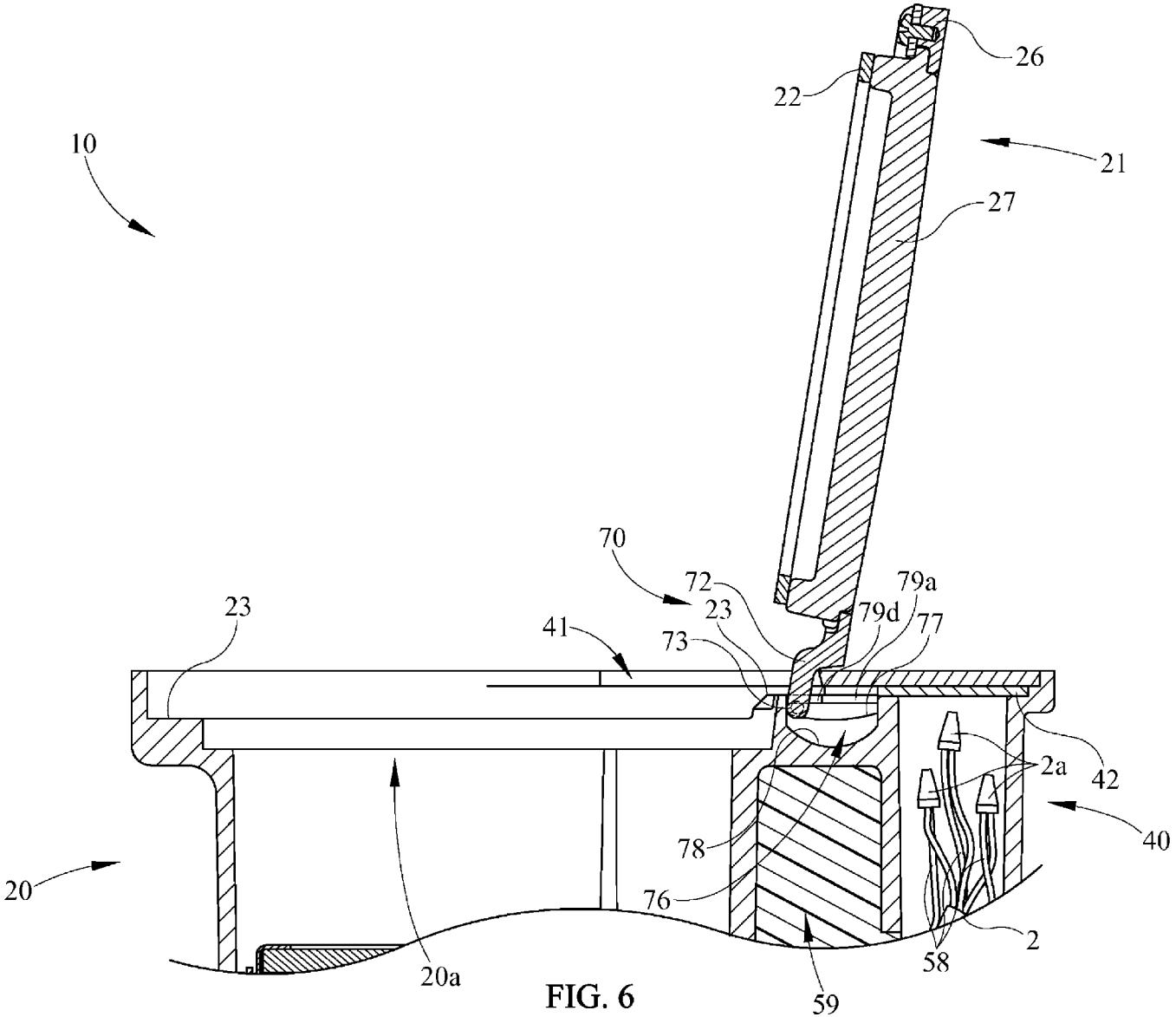
FIG. 6 is an enlarged sectional view of the joint connection of the lens cover in an open configuration taken along line 4-4 of FIG. 3.

As shown in FIGS. 1-6, lens cover 21 having lens 27 and lens ring 26 are in sealing engagement with lamp compartment 20. Lens gasket 22 may be of a silicone composition. Lens ring 26 which has an arm 72 on one side may be formed of a brass or stainless steel. Lens cover 21 may be positioned in a closed configuration (FIGS. 1, 2, and 4) permitting a sealing engagement with lamp compartment 20, and in an open configuration (FIGS. 3, 5, and 6) whereby ballast cover 33, ballast box 31, and lamp module 60 may be inserted or removed from lamp compartment 20. One embodiment of lens cover 21 has a joint connection 70 between arm 72 and lamp compartment 20. Joint connection 70 may provide a pin-in-slot joint engagement as discussed below permitting both translational and rotational movement of lens 27. The pin-in-slot engagement allows the joined bodies to pivot with respect to each other and to translate with respect to each other. Previously, a hinged connection would allow only rotation of a lens about a fixed axis. Lens 27 may be able to rotate upwards away from compartment 20 from about 0 to about 180 degrees, preferably past the 90 degree point to allow a "hands free" position wherein lens cover 21 remains naturally in an open configuration allowing accessibility of the interior of the light fixture. As shown in FIG. 6, lens 27 may be restricted from opening past about 93 degrees due to contact between arm 72 and other structures of the light fixture, such as junction box cover 41. Joint connection 70 allow for engagement between arm 72 and a socket 76 provided in lamp compartment 20. Lens cover 21 as shown in FIGS. 2-6 has lens ring 26 circumscribing lens 27 and having arm 72 projecting therefrom. Arm 72 includes one or more projecting or opposing pins 73. Socket 76 with at least one cam surface 77, however socket 76 is shown as having two cam surfaces 77 (see FIG. 3 showing one of such cam surfaces) spaced on opposite sides of a deeper groove 78 of the socket. A left cam cover 79*a* and a right cam cover 79*b* define the upper portion of the socket 76 and are disposed over each respective cam surfaces 77. Left and right cam cover 79*a* and 79*b*, respectively, define an aperture 79*c* (FIG. 3) permitting rotational movement of arm 72 and lens 27 upwards away from compartment 20 and translational movement within socket 76 radially towards the center of open upper end 20*a* of compartment 20. Not only does joint connection 70 allow for translational and rotational movement, joint connection 70 may be "open" such as to releasably secure or separate lens cover 21 from lamp compartment 20. Lens cover 21 with arm 72 may be separated from socket 76, as shown in FIG. 3, if desired by the user, by permitting pins 73 to travel through opposing slots 79*d* on either side of cam cover aperture 79*c*. Opposing slots 79*d* permit insertion and removal of opposing pins 73 on lens cover arm 72. Opposing pins 73 and arm 72 are inserted and retained within socket 76 as they are cammed under cam covers 79*a* and 79*b*. Arm 72 with opposing pins 73 travel along each of cam surfaces 77 permitting lens cover 21 to travel between the closed configuration and the open configuration. When lens cover 21 is placed in the closed configuration as shown in FIGS. 1, 2, and 4, arm 72 is forced upward as it rolls along the linear curvature of cam 76, thus, compressing gasket 22 to sealingly engage lamp compartment 20 by placing a downward force on ring 26 coupled with lens fasteners 21*a*. As shown in FIG. 4, gasket 22 in the closed configuration will typically seal against a vertical peripheral surface and a bottom horizontal surface of lamp compartment 20. As shown in FIGS. 4-6, when lens cover 21 is opened, the arm 72 of lens cover 21 moves translationally and rotationally along cam surfaces 77 relative to lamp compartment 20. The open configuration of lens cover permits access to lamp compartment 20 through open upper end 20*a*. More specifically, opposing pins 73 travels along cam surfaces 77 under bracket cam covers 79*a* and 79*b* from the closed configuration to the open configuration. The middle section of groove 78 permits the distal end or portions of the arm 72 to rotate about pins 73 within socket 76 and may also advantageously retain any accumulated dirt or debris within socket 76 while still permitting joint connection 70 to function.

As shown in FIG. 4, in a closed configuration lens gasket 22 is compressed between lens 27 and lamp compartment 20 by placing a downward force on lens ring 26 coupled with joint connection 70 and opposing lens fasteners 21*a*. Again the compression of gasket 22 is limited by the engagement between ledge 23 of lamp compartment 20 and ring 26. Upon removal of lens fasteners 21*a*, gasket 22 has sufficient elasticity to uncompress and raise lens cover 21 opposite joint connection 70 to enabling a user to grasp the lens ring and open the lens cover without the use of a handle. Lens cover 21 is translationally moved outwards away from junction box cover 41 and rotated upwards away from lamp compartment 20. During the translational movement, arm 72 with opposing pins 73 translates within socket 76 along the linear curvature of cam surfaces 77 towards the center of lamp compartment open upper end 20*a* while the lens ring 26 and lens 27 rotates upwards away from lamp compartment 20. Cam surfaces 77 are shown in FIGS. 3-6 as concave in shape, but are not limited to such. As arm 72 of lens cover 21 translationally travels from its closed configuration position to its open configuration position within socket 76, the opposing pins 73 traverse below the opposing aperture slots 79*d* of left and right cam covers 79*a* and 79*b*. Again, the user may apply an upward force to remove lens cover 21 by passing the opposing pins 73 through the slots 79*d*, thus creating an "open" joint or releasable joint connection. However, joint connection 70 may be a "closed" joint (not shown) that lens cover 21 may not be releasable. Opposing pins 73 are shown as fixed but may be rotatable relative to the remainder of the arm 72 or have rollers affixed to each pin and still function to travel along the cam surfaces 77. Translational movement of the lens cover 21 within socket 76 when traveling to the open configuration is not limited to radially towards the center of the open upper end 20*a*. For example translational travel may be in the opposite direction radially away from the center of the open upper end 20*a* when opening the lens cover.

As depicted in FIGS. 3-6, joint connection 70 of light fixture 10 permits the user to open lens cover 21 to provide access to the interior of lamp compartment 20 and ballast compartment 30. A pivotable lens cover 21 reduces the amount of dirt and other contaminates that might otherwise be introduced to gasket 22 or lens cover 21 if it were removed from lamp compartment 20. Because the lens cover 21 is pivotable, the user does not have to remove the lens cover and separate from fixture 10 but positions the lens cover to the open configuration. Once in the open configuration, the user has both hands available for maintenance and installation of, but not limited to, lamp module 60, ballast box cover 33, and ballast box 31. However, lens cover 21 may still be removed if required by the user. Also, the sealing engagement of junction box cover 41 with junction box 40 is maintained while lens cover 21 is being opened, closed, or removed. The joint connection 70 also allows a substantially flush appearance to be maintained between junction box cover 41 and lens cover 21 when each are in the closed configuration. The pivoting construction of lens cover 21 reduces the number of fasteners required to secure the lens cover and compress gasket 22. As shown in FIGS. 1-3, fasteners 21*a* need only to be positioned opposite joint connection 70 instead of around the entire periphery of lens cover 21 as required in previous designs. A reduced number of fasteners reduces the time required for engaging and disengaging lens cover 21 from lamp compartment 20 as well as eliminating the need for a "star pattern" torque sequence required in previous designs to prevent the lens cover from unevenly seating and over compressing the gasket which would adversely affect the sealing properties of the gasket.

Although one embodiment of joint connection 70 is shown in FIGS. 2-6, it is to be understood that the joint connection concept shown in the drawings may take on a variety of shapes, sizes, constructions, and orientations and still provide rotational and translation movement of lens cover 21 or any other cover or lid applied to light fixture 10. For example, a junction box cover or a ballast cover each may have a joint connection 70 by itself or in combination with lens cover 21.

As shown in FIG. 2, lamping module 60 is comprised of a reflector 63, lamp 64, and lamp socket 65, the lamp socket being electrically connected by lamp wires 38*b* to ballast box 31. Within lamping module 60, lamp 64 which may be either incandescent, fluorescent, LED, or HID, emits the desired light which may be reflected by a reflector 63, if desired. The light passes through the lamping module lens 67, if used in the fixture, providing illumination through lens 27 of lamp compartment 20. Lamping module 60 may be placed on a gimbal mechanism 62 to provide, for example, up to about 15 degrees of tilt and 360 degrees of rotation. By separating lamping module 60 from the remaining electronics and construction of the in-grade fixture 10, relamping of fixture 10 becomes a relatively easy task. Positioning lens cover 21 into an open configuration as shown in FIGS. 3, 5, and 6 permits a user to remove the entire lamping module 60 and replace it without having to enter into any of the other sealed compartments provided within the in-grade fixture 10 as described herein.

As shown in FIG. 2, lamping module 60 is in electrical communication with ballast box 31 through lamp wires 38*b*. A ballast box 31 is needed for HID lamps, LEDs, and fluorescents but will not be required for incandescent lamps. Ballast box 31 is electrically connected to junction box 40 by ballast wires 38*a* and internal electrical wires 58. As depicted in FIGS. 2 and 7-9, ballast box 31 may be releasably secured to a substantially vertical projection 34 depending from the bottom surface of ballast cover 33. By doing so, ballast box 31 may be readily installed and removed by removing ballast cover 33 from its sealing engagement with ballast compartment 30. Ballast cover 33 may be of aluminum coated with a kalium dichromate finish. Ballast cover 33 may also have a handle 35 (FIG. 8) for user convenience when handling. Ballast box 31, having a number of electronic components located therein, may be a brick ballast module in that it may be filled with potting material encasing the interior of the ballast module to assure a continued moisture-free environment for the electronics placed therein. Alternatively, a ballast may be provided in the lamping module for designs using a fluorescent lamp.

Figure 8:
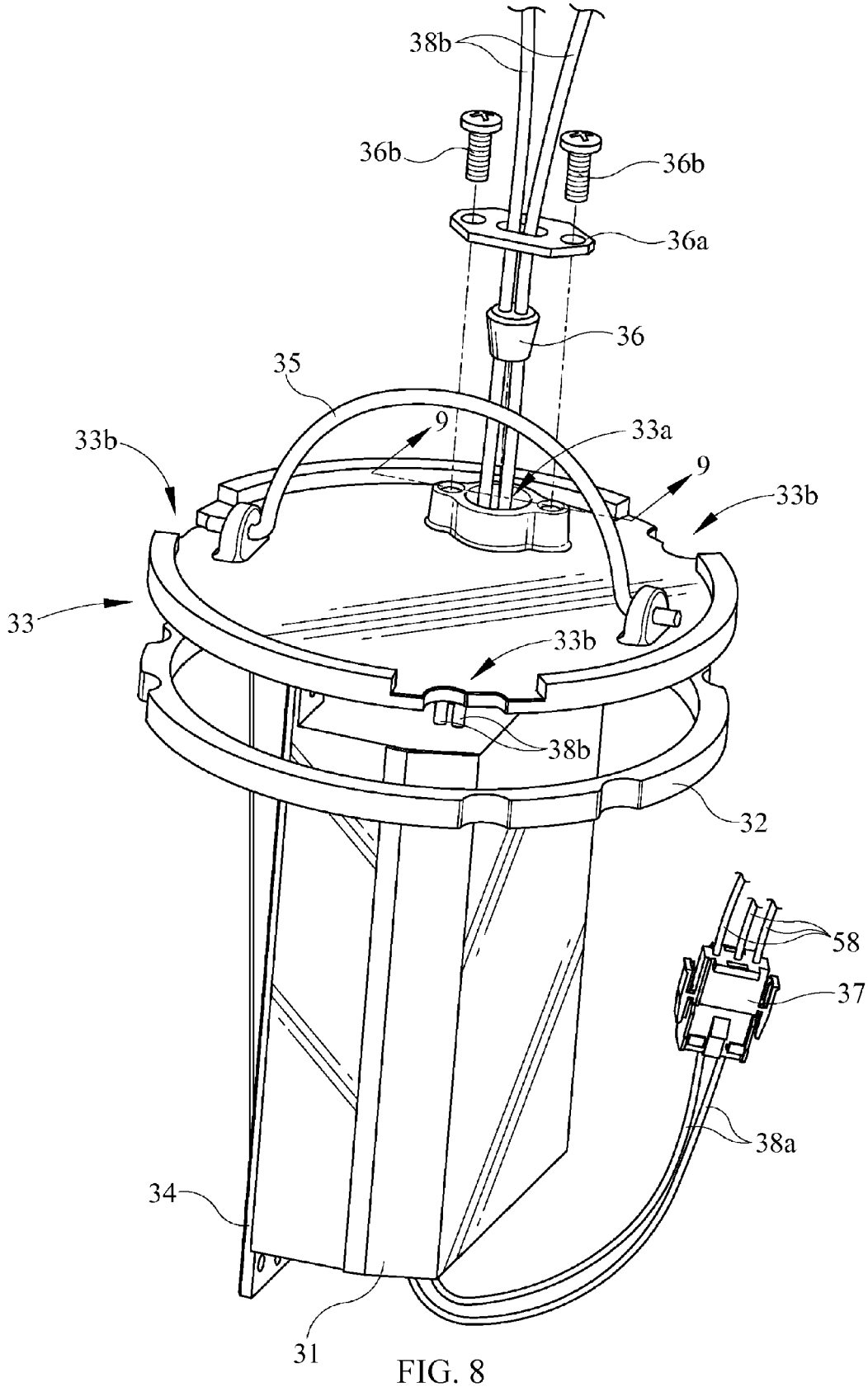
FIG. 8 is a perspective view of a ballast cover of the in-grade light fixture of FIG. 1 with the gasket, grommet, bracket, and fasteners exploded away from the ballast cover.
Figure 9:
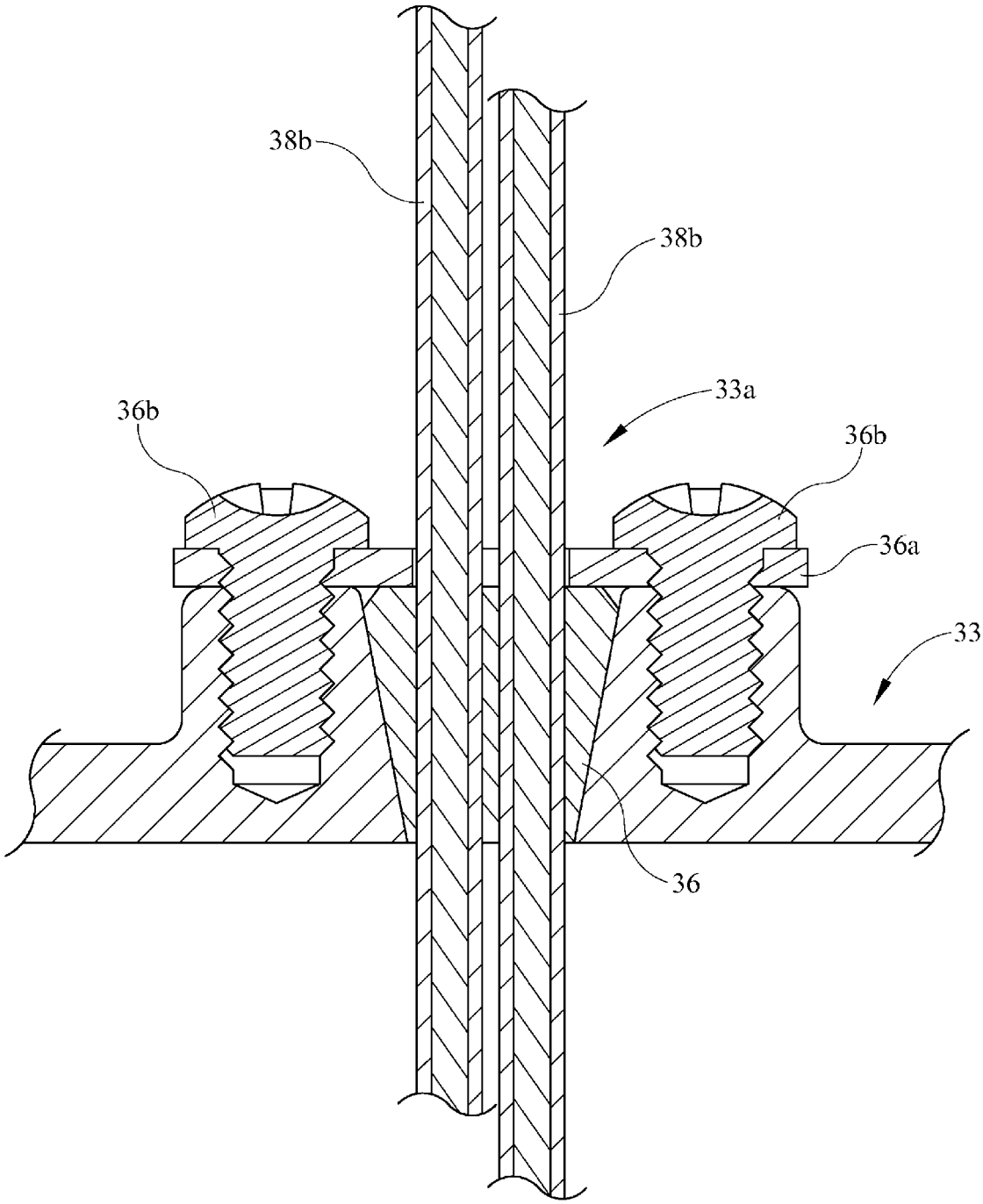
FIG. 9 enlarged sectional view of the ballast cover with the inserted grommet and bracket taken along line 9-9 of FIG. 8.

As shown in FIGS. 2 and 8, ballast box 31 may be releasably secured adjacent ballast cover 33 through a variety of attachments using, for example, mechanical or adhesive means, or it may be releasably secured (not shown) to ballast compartment 30. As shown in FIG. 8, lamp wires 38*b* passes through aperture 33*a* of ballast cover 33 via a grommet 36 having at least one opening or a plurality of openings, permitting the wires 38*b* to pass through together or individually. Aperture 33*a* of ballast cover 33 may be tapered (FIG. 9) for sealing engagement with a tapered grommet 36 (FIGS. 8 and 9). Grommet 36 may be of a silicone composition or 100% silicone. As shown in FIG. 9, a bracket 36*a* pulled down by fasteners 36*b* acts to compress and seal grommet 36 within tapered aperture 33*a* of ballast cover 33, and squeezes lamp wires 38*b* creating a secured and sealed engagement. Thus, secured, grommet 36 acts to form a seal about lamp wires 38*b* where they extend between ballast compartment 30 and lamp compartment 20 through ballast cover 33. Ballast cover 33, as described above and shown in FIG. 8, carries or rests against a gasket 32 or other sealing mechanism to form a seal with ballast compartment 30. Gasket 32 may be a molded member, such as a silicone gasket. As shown in FIGS. 7 and 8, a plurality of key slots 33*b* permits the use of fasteners 34 to compress gasket 32 of the ballast cover 33 to a point against ballast compartment 30 where a series of bosses 39, spaced apart by 120 degrees, limits over-compression. Gasket 32, as shown in FIG. 2, may seal on a substantially vertical peripheral surface and bottom horizontal surface of ballast compartment 30.

Upon assembly, ballast box 31 and cover 33 are inserted through open upper end 20*a* and open lower end 20*b* of lamp compartment 20, and ballast wires 38*a* are placed appropriately in the male/female connection 37 which connects them with internal electrical wires 58 from junction box 40. Subsequently ballast cover 33 is sealingly engaged with ballast compartment 30. Lamp wires 38*b* projecting from ballast cover 33 through grommet 36 are subsequently connected to lamp module 60 upon the insertion of the lamp module into lamp compartment 20. Subsequently, lens cover 21 is positioned in sealing engagement with open upper end 20*a* of lamp compartment 20.

One advantage of in-grade fixture 10 is that by providing the vertically extending hydraulic isolation chamber 50 with potting material 59 that encompasses internal wires 58 and bare wires 58*a*, ballast compartment 30 is protected from water seepage originating in junction box 40. More specifically, by isolating bare wires 58*a* with potting material 59 within hydraulic isolation chamber 50, a hydraulic barrier is presented which allows for electrical communication from the sealed junction box 40 to the sealed ballast compartment 30 and continuing to lamp module 60 of the sealed lamp compartment 20, while preventing any disruption due to moisture entering therein.

By means of the structure of in-grade light fixture 10, moisture is prevented from entering into ballast compartment 30 through wicking or other leaking mechanisms and this prevents moisture from entering into lamp compartment 20. Water ingress is prevented through the use of potting material 59 encasing internal electrical wires 58 extending through the chamber 50 and also utilizing the potting material surrounding bare wire 58*a* within groove 54 to prevent wicking along the wires 58. Hydraulic isolation chamber 50 may be set with the potting material 59 prior to shipment of the combined fixture so that no additional entry into the hydraulic isolation chamber is required upon installation of in-grade light fixture 10. Upon installation, the user merely has to connect external wires 2 at side car junction box 40, seal the line voltage entry 48 and exit points, if present, and seal cover 41 over the junction box opening 40*a*.

It is understood that while certain embodiments of the invention have been illustrated and described, it is not limited thereto except insofar as such limitations are included in the following claims and allowable functional equivalents thereof.

We claim:

1. An in-grade light fixture comprising:

a lamp compartment having an upper end and a lower end, said upper end covered by a lens cover in sealing engagement with said lamp compartment, said lamp compartment containing a lamp; and a joint mechanism on said lens cover having an arm interacting with a socket of said lamp compartment permitting rotational and translational movement of said lens cover from a closed position to an open position relative to said lamp compartment; and a ballast compartment adjacent said lower end of said lamp compartment, said ballast compartment separated from said lamp compartment by a ballast cover in sealing engagement with said ballast compartment, said ballast compartment containing a ballast box in electrical communication with said lamp.

2. The in-grade light fixture as in claim 1 wherein said ballast cover has an upper surface and a lower surface, said upper surface has a handle and said lower surface has a depending bracket supporting said ballast box, said ballast cover has an opening between said upper surface and said lower surface containing a grommet, said grommet sealing a wire extending from said ballast box into said lamp compartment.

3. The in-grade light fixture as in claim 2 further comprising a gasket positioned between said ballast cover and said ballast compartment, said gasket seals against a substantially vertical peripheral surface and a substantially horizontal annular surface of said ballast compartment.

4. The in-grade light fixture as in claim 3 wherein said substantially horizontal annular surface of said ballast compartment has a plurality of bosses.

5. The in-grade light fixture as in claim 1 wherein said ballast cover further has an opening and a wire connected to said ballast box and sealingly extending into said lamp compartment through said opening.

6. The in-grade light fixture as in claim 5 wherein said opening further has a grommet therein sealing said wire extending through said ballast cover.

7. The in-grade light fixture as in claim 1 wherein said lens cover includes a lens and a gasket between said lens and said lamp compartment.

8. An in-grade light fixture comprising:

a lamp compartment having an upper end and a lower end, said upper end covered by a lens cover in sealing engagement with said lamp compartment, said lamp compartment containing a lamp;

a socket adjacent said lamp compartment, said socket having an elongated cam mechanism;

an arm projecting from said lens cover having opposing projections, said opposing projections engage along said elongated cam mechanism of said socket to permit said lens cover to travel from a closed position to an open position relative to said compartment;

a lamp power device compartment adjacent said lower end of said lamp compartment, said lamp power device compartment separated from said lamp compartment by a lamp power device cover in sealing engagement with said lamp power device compartment;

a lamp power device retained within said lamp power device compartment and extending through said lamp power device cover, said lamp power device mounted on a substantially vertical projection of said lamp power device cover; and a wire in communication from said lamp power device through said lamp power device cover to said lamp.

9. The in-grade light fixture as in claim 8 wherein said lamp power device is a ballast box.

10. The in-grade light fixture as in claim 8 wherein said lamp power device cover further has a depending projection whereby said lamp power device is attached thereto.

11. The in-grade light fixture as in claim 8 wherein said lamp power device cover further has a grommet sealing said wire through said lamp device cover.

12. The in-grade light fixture as in claim 8 further has a gasket in position between said lamp power device cover and said lamp power device compartment.

13. The in-grade light fixture as in claim 12 wherein said lamp power device compartment further has a plurality of bosses whereby limiting the compression of said gasket.

14. An in-grade light fixture comprising:

a lamp compartment having a rim, an upper end and a lower end, said upper end covered by a lens cover in sealing engagement with said lamp compartment, said lamp compartment containing a lamp;

said lens cover having a projecting arm releasably received in an arm receptacle at said lamp compartment rim allowing said lens cover to rotate and translate from a sealed position to an open position relative to said lamp compartment rim and be moved away from said lamp compartment rim and removed;

a ballast compartment adjacent said lower end of said lamp compartment, said ballast compartment separated from said lamp compartment by a ballast cover in sealing engagement with said ballast compartment, said ballast compartment containing a ballast box;

a side car junction box adjacent said lens cover and having an upper end covered by a junction box cover in sealing engagement with said side car junction box; and a substantially vertical hydraulic isolation chamber in pathway communication with said side car junction box and extending to said ballast compartment.

15. The in-grade light fixture as in claim 14 wherein said hydraulic isolation chamber further includes a potting material.

16. The in-grade light fixture as in claim 14 wherein said ballast box is releasably secured to said ballast cover.

17. The in-grade light fixture as in claim 14 wherein said lens cover includes a lens and a gasket between said lens and said lamp compartment.

18. The in-grade light fixture as in claim 14 further comprises a gasket in position between said ballast cover and said ballast compartment.

19. The in-grade light fixture as in claim 14 wherein said ballast cover further has an electrical conduit connecting said ballast box and said lamp in sealing engagement therethrough.

20. The in-grade light fixture as in claim 14 wherein said ballast cover further has a grommet sealing said electrical conduit through said ballast cover.

* * * * *